US006500220B1

(12) United States Patent
Krueger et al.

(10) Patent No.: US 6,500,220 B1
(45) Date of Patent: Dec. 31, 2002

(54) IMPREGNATED GRINDING WHEEL

(75) Inventors: Mark K. Krueger, Loveland, OH (US); Soo C. Yoon, Cincinnati, OH (US); Ken G. Forney, Cincinnati, OH (US); Henry Turchin, Liberty Township, OH (US); Cor A. Smits, Bethel, OH (US)

(73) Assignee: Cimcool Industrial Products, Inc., Cincinnati, OH (US)

( * ) Notice: Subject to any disclaimer, the term of this patent is extended or adjusted under 35 U.S.C. 154(b) by 0 days.

(21) Appl. No.: 10/078,036

(22) Filed: Feb. 19, 2002

(51) Int. Cl.[7] ..... B24B 1/00

(52) U.S. Cl. ..... 51/306; 451/534; 451/540; 451/544; 451/548; 51/295; 51/296; 51/297; 51/300; 51/309

(58) Field of Search ..... 451/534, 540, 451/544, 548; 51/295, 296, 297, 300, 306, 309

(56) References Cited

U.S. PATENT DOCUMENTS

| | | | | |
|---|---|---|---|---|
| 3,058,819 A | | 10/1962 | Paulson | |
| 4,190,986 A | | 3/1980 | Kunimasa | |
| 4,784,671 A | | 11/1988 | Elbel | |
| 4,877,824 A | | 10/1989 | Evans | |
| 5,062,977 A | | 11/1991 | Germanaud et al. | |
| 5,192,339 A | * | 3/1993 | Hasegawa et al. | 51/309 |
| 5,198,134 A | | 3/1993 | Steinberg et al. | |
| 5,441,549 A | | 8/1995 | Helmin | |
| 5,507,850 A | | 4/1996 | Helmin | |
| 5,551,962 A | | 9/1996 | Ho | |
| 5,607,489 A | * | 3/1997 | Li | 51/309 |
| 5,738,695 A | | 4/1998 | Harmer et al. | |
| 6,086,648 A | | 7/2000 | Rossetti, Jr. et al. | |

FOREIGN PATENT DOCUMENTS

| | | |
|---|---|---|
| JP | 57-030796 | 2/1982 |
| JP | 64-014275 | 1/1989 |
| JP | 59-089395 | 5/1994 |
| JP | 11-005990 | 1/1999 |
| JP | 2000-336228 | 12/2000 |

* cited by examiner

*Primary Examiner*—M. Rachuba
*Assistant Examiner*—Shantese McDonald
(74) *Attorney, Agent, or Firm*—John W. Gregg; Donald Dunn

(57) ABSTRACT

A vitreous bonded abrasive article, more particularly a grinding wheel, having improved grinding performance is provided wherein the open pores of the abrasive article contain an impregnant which comprises at least one water insoluble, sulfur bearing organic substance having at least one carbon to sulfur bond, at least about 5% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances grinding aid. The impregnant is free of a medium, other than the water insoluble, sulfur bearing substance, in which the substance or a mixture of such substances is dissolved or dispersed. Vitreous bonded grinding wheels in accordance with the invention showing improved grinding performance have been produced having open pores containing an impregnant comprising a water insoluble, sulfur bearing substance in accordance with the following formula as the sole constituent of the impregnant.

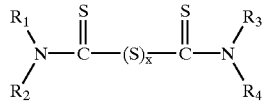

wherein $R_1$, $R_2$, $R_3$ and $R_4$ are the same or different and are selected from the group consisting of alkyl, aryl, cycloalkyl, arylalkyl and alkylaryl groups and x is from 1 to 6.

41 Claims, No Drawings

IMPREGNATED GRINDING WHEEL

I. FIELD OF INVENTION

This invention relates to vitreous bonded abrasive articles, particularly vitreous bonded grinding wheels. More particularly this invention relates to vitreous bonded abrasive articles having impregnated therein a grinding aid.

II. BACKGROUND OF THE INVENTION

Vitreous bonded abrasive articles have abrasive grains bonded by a vitreous matrix and are used to mechanically shape solids by material removal effected by an abrading action in which the abrasive grains cut material from the solid. It is known to abrasively shape solids of various materials, including, for example, metals, glasses and ceramics. Vitreous bonded abrasive articles are commonly formed into shapes suitable for machining wherein a rotating tool contacts a solid workpiece to be machined by the abrasive grains, most commonly such articles are formed into wheels and rims for wheels (machining is performed primarily by the circumference of the wheel), or disks and segments for disks (machining is performed primarily by the side of the disk), wheels and disks for bonded abrasives are herein referred to as "grinding wheels". It is known to produce vitreous bonded abrasive articles having voids or "pores" in the matrix, interconnected voids being referred to as "open pores". The pore structure of a vitreous bonded abrasive article affects a number of characteristics of the article including, for example, its physical strength, the rate of break down of the article into fresh cutting edges, and its effectiveness to eliminate swarf and to deliver metalworking fluid into the zone of material removal. In a vitreous bonded grinding wheel having open pore structure it is known to at times have a random distribution of pore sizes and shapes (some pores being relatively large and some pores being relatively small). Thus vitreous bonded grinding wheels may have a heterogeneous open pore structure with respect to pore size, shape and distribution.

As is well known, heat produced in abrasive shaping of solids, e.g. grinding of workpieces, can increase the rate of wheel wear and, in extreme cases, can adversely affect the quality of workpieces, producing out-of-tolerance dimensions, unacceptable surface finishes, as well as scorching workpiece material. The heat produced during grinding in large measure is the result of the sliding friction between the abrasive grain of the grinding wheel and the workpiece. The amount of heat produced can depend on many factors including, but not limited to, the composition and structure of the abrasive grain, the nature of the workpiece, the depth of cut taken during grinding, wheel speed and the vitreous bond used to bind together the abrasive grain. In the art it is known that different grinding operations (e.g. surface, internal, roll, plunge, snagging, creep feed, cut off) involve different forces, speeds, temperatures, infeed rates, metal removal rates and workpiece materials. Some grinding operations (e.g. finish or surface grinding) may employ relatively mild physical conditions involving low forces, infeed rates and metal removal rates. Other grinding operations (e.g. creep feed, plunge cut and cut off grinding) may employ relatively severe physical conditions such as high forces, infeed rates and high metal removal rates. It is therefore known in the art to produce vitreous bonded grinding wheels tailored to particular types of grinding operations and/or workpieces. Thus different vitreous bonded grinding wheels may be used for surface, plunge cut, internal, creep feed and roll grinding operations as well as for different workpiece materials such as various metals, glass and ceramic workpiece materials. Such grinding wheels may differ in the amount and kind of abrasive grain, vitreous bonding material and structure and degree of porosity.

To reduce or eliminate heat produced during grinding and thereby improve grinding performance and efficiency, it is known in the art to use metalworking fluids, more commonly called grinding fluids, in the grinding operation. These fluids are generally water or oil based fluids and are in many cases known to reduce friction and remove heat during grinding. The reduction of friction between the abrasive grain and the workpiece by the fluids can reduce the heat generated during grinding. The ability of these fluids to reduce friction between the grinding wheel and components thereof and the workpiece, and to remove heat during grinding may depend upon such factors as the composition of the fluid and the ability of the fluid to penetrate into the interface between the workpiece and grinding wheel, more particularly the interface between the workpiece and the abrasive grain during grinding. Penetration of the grinding fluid into the interface between the grinding wheel and workpiece, also known as the workzone, may in part be achieved by the rotating grinding wheel carrying grinding fluid into the grinding zone, at least partially by the open pore structure of the wheel at the grinding face of the wheel. Disadvantageously, interaction of the grinding wheel and the grinding fluid tends to displace fluid from the grinding zone and may produce mist that is susceptible of transport well beyond the grinding zone increasing the measures necessary for maintaining a clean working environment.

One way the art has sought to overcome disadvantages of use of grinding fluids and at the same time improve grinding performance of vitreous bonded grinding wheels is by impregnating grinding aids, such as lubricants into the pores of the wheel. The pores deliver the grinding aid to the grinding zone in this approach. To function as a grinding aid the impregnant or a component thereof must be available in the grinding zone in sufficient quantity to reduce friction or otherwise improve cutting efficiency so as to improve grinding performance. In the art sulfur, waxes, oils, graphite and halogen bearing polymers have been some of the materials impregnated into vitreous bonded grinding wheels in an effort to improve the grinding performance of the wheels in grinding operations which may or may not use grinding fluids (i.e. wet and dry grinding).

Because noxious sulfur vapors can be produced in the process of impregnation of bonded abrasives with sulfur and objectionable fumes can be given off during dry grinding with sulfur impregnated bonded abrasives, use of sulfur impregnated wheels has been limited in spite of the improved grinding performance obtained with such wheels.

Various oils have been used or proposed by the art to impregnate vitreous bonded grinding wheels. During grinding the rotating wheel creates centrifugal forces acting on the oil in the pores of the wheel. This centrifugal force tends to cause the premature expulsion of the oil from the wheel and/or can cause the oil to concentrate at the periphery of the wheel leaving the interior of the wheel devoid of oil or having a significantly reduced concentration of oil. The resulting wheel can adversely exhibit varying or decreasing grinding performance over the life of the wheel during a grinding operation. Lubricating oils, including low viscosity, non-polar, hydroscopic liquid oils, have been incorporated into waxes having melting points above room temperature as a means of impregnating vitreous bonded grinding wheels with the oil to improve their grinding performance. The wax serves as a carrier for the oil and aids in retaining the oil in the pores against the action of centrifugal forces generated by the rotating grinding wheel during grinding. At the grinding zone heat generated during grinding melts the wax carrier releasing the oil whereby the oil is available for reducing friction during grinding. In this approach, the impregnated wheel would have a lower concentration of oil for friction reduction than the direct impregnation of oil into the wheel, by an amount equal to the amount of carrier wax used.

Although improvements in grinding performance have to varying degrees been obtained with prior art impregnated vitreous bonded grinding wheels such wheels exhibit various shortcomings that can reduce their desirability and/or expected performance. These shortcomings and the limited use of impregnated vitreous bonded grinding wheels point out the need for improvements in impregnated vitreous bonded grinding wheels.

III. SUMMARY OF THE INVENTION

It is an object of this invention to provide an impregnated vitreous bonded abrasive article (e.g. grinding wheel) overcoming shortcomings of known vitreous bonded abrasive articles impregnated with grinding aids.

A further object of this invention is to provide an impregnated vitreous bonded abrasive article (e.g. grinding wheel) having a sulfur bearing organic substance impregnated therein as a grinding aid, the substance being solid at room temperature.

A still further object of this invention is to provide an impregnated vitreous bonded abrasive article (e.g. grinding wheel) having a sulfur bearing organic substance impregnated therein as a grinding aid, the substance being water insoluble and solid at room temperature.

These and other objects as will become apparent to one skilled in the art from the following description and accompanying claims are achieved in accordance with this invention by an impregnated vitreous bonded abrasive article, more particularly a vitreous bonded grinding wheel impregnated with a grinding aid, the grinding wheel comprising a plurality of abrasive grains, a vitreous matrix binding together the abrasive grains and having distributed therein a plurality of open pores, at least a portion of said pores containing an impregnant wherein said impregnant comprises a water insoluble, sulfur bearing organic substance having at least one carbon to sulfur bond, at least 5% by weight sulfur and a melting point of at least about 30° C., said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed.

The impregnated vitreous bonded grinding wheel in accordance with this invention provides a sulfur bearing organic substance at the grinding interface between the wheel and a workpiece (i.e. grinding zone) that, it is believed, in response to the heat produced at the grinding zone during grinding releases or makes available in the grinding zone sufficient sulfur bearing substances to reduce friction between the workpiece and the abrasive grains and/or other components of the grinding wheel (e.g. vitreous bond), hence functioning as a grinding aid. Such friction reduction at least in part results in reduced grinding forces, increased grinding performance (e.g. higher G-ratio, increased metal removal rate) and increased grinding efficiency.

IV. DETAILED DESCRIPTION OF THE INVENTION

As used in this description and the appended claims the term impregnant shall mean the substance or substances introduced into and retained in the open pore structure of the vitreous bonded abrasive article. The term "water insoluble" as used in this description and the appended claims shall mean substantially insoluble in water, that is solubility in water of 1 gram or less per 100 grams of water at room temperature. In this description and the appended claims the term "dissolved" shall mean present in molecular and/or atomic and/or ionic form in a continuous matrix. The term "dispersed" as used herein and the appended claims shall mean present in micellular and/or agglomerate and/or particulate and/or droplet form in a continuous matrix. As used herein and the appended claims, "open pores" shall mean interconnected unenclosed spaces or voids within the bond of the abrasive article. The phrases "interface between the grinding wheel and the workpiece", "interface between the abrasive grains and the workpiece" and "interface between the components of the grinding wheel and the workpiece" are used interchangeably with and have the same intended identity as the phrase "grinding zones". As used herein and the appended claims "grinding aid" shall mean a substance, when available in sufficient quantity in the grinding zone, functions to reduce friction, increase cutting efficiency or otherwise to improve grinding performance. As used herein and the appended claims the word "medium" shall mean and describe a continuous phase in which a material is dissolved or dispersed, for example a hydrocarbon solvent that dissolves a hydrocarbon oil. The phrase "medium other than said substance" as used in the context of this description and the appended claims shall identify a continuous organic phase that is not the water insoluble, sulfur bearing organic substance in accordance with this described and claimed invention. As used in the context of this description and the appended claims it is intended that the phrase "plurality of abrasive grains" shall apply to both the number of abrasive grains and to the size and composition of the abrasive grains (e.g. a mixture of abrasive grains of different composition and structure).

In accordance with this invention there has been found an impregnated vitreous bonded abrasive article, more particularly a vitreous bonded grinding wheel impregnated with a grinding aid, still more especially a sulfur bearing organic substance impregnated vitreous bonded grinding wheel showing improved grinding performance over comparable unimpregnated vitreous bonded grinding wheels. The sulfur bearing organic substance impregnated grinding wheel in accordance with this invention resists premature loss or change in distribution of the impregnant caused by centrifugal forces produced by rotation of the grinding wheel. Additionally it was found that the impregnated vitreous bonded grinding wheel in accordance with this invention does not require and therefore does not have a carrier, that would be other than said sulfur bearing organic substance, for the sulfur bearing organic impregnant.

It is believed that heat produced during grinding by contact of a workpiece and a grinding wheel in accordance with this invention causes the release of the impregnant of the impregnated grinding wheel in the grinding zone and that this released impregnant is effective as a grinding aid to reduce friction and increase grinding performance.

In accordance with this invention there is provided a vitreous bonded abrasive article comprising a plurality of abrasive grains, a vitreous matrix binding together the abrasive grains and having distributed therein a plurality of open pores, at least a portion of said pores containing as an impregnant therein a grinding aid wherein said impregnant comprises at least one water insoluble, sulfur bearing organic substance said substance having at least one carbon to sulfur bond, at least about 5% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or a mixture of said substances is dissolved or dispersed.

In another aspect of this invention there is provided a vitreous bonded abrasive article (e.g. grinding wheel) comprising a plurality of abrasive grains, a vitreous matrix binding together the abrasive grains and having distributed therein a plurality of open pores, at least a portion of said pores containing as an impregnant therein a grinding aid wherein said impregnant comprises at least one water insoluble, sulfur bearing organic substance said substance having at least one carbon to sulfur bond, a sulfur content in the range of from about 10% to about 60% by weight and a melting point of at least about 30° C. said melting point being at least 10° C. preferably at least 20° C. below the decomposition temperature of the substance and selected from the group consisting of aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed.

There is provided in accordance with one practice of this invention a vitreous bonded abrasive article (e.g. grinding wheel) comprising a plurality of abrasive grains, a vitreous matrix binding together the abrasive grains and having distributed therein a plurality of open pores, at least a portion of said pores containing as an impregnant therein a grinding aid wherein said impregnant comprises at least one water insoluble, sulfur bearing organic substance said substance having at least one carbon to sulfur bond, a sulfur content of at least about 10% by weight, and a melting point in the range of from about 30° C. to about 500° C., said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or a mixture of said substances is dissolved or dispersed.

Another practice of this invention provides a vitreous bonded abrasive article (e.g. grinding wheel) comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, a sulfur content in the range of from about 20% to about 60% by weight and a melting point in the range of from about 40° C. to about 250° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or a mixture of said substances is dissolved or dispersed.

There is further contemplated in accordance with this invention a vitreous bonded abrasive article (e.g. grinding wheel) comprising a plurality of abrasive grains, a vitreous matrix binding together the abrasive grains and a plurality of open pores at least a portion of said pores containing an impregnant wherein the impregnant comprises at least one water insoluble, sulfur bearing organic substance said substance having at least one carbon to sulfur bond, at least one carbon to halogen bond, for example, a carbon to chlorine bond, in the range of from about 15% to about 60% by weight sulfur and a melting point in the range of from about 40° C. to about 250° C., said melting point being at least 20° C., below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant free of a medium, other than said substance, in which said substance or mixture of said substances is dissolved or dispersed.

As an embodiment of this invention there is provided a vitreous bonded abrasive article (e.g. grinding wheel) comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed and wherein at least one of said substances has the general formula

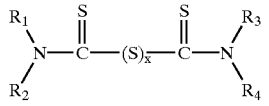

wherein $R_1$, $R_2$, $R_3$ and $R_4$ are the same or different and are selected from the group consisting of alkyl, cycloalkyl, aryl, alkylaryl and arylalkyl group and x is from 1 to 6.

As a further embodiment of this invention there is provided a vitreous bonded abrasive article comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing substances or a mixture of said substances, said impregnant being free of a medium, other than said substance, in which said substance or mixture of said substances is dissolved or dispersed and wherein at least one of said substances has the general formula

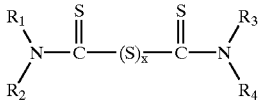

wherein $R_1$, $R_2$, $R_3$ and $R_4$ are the same or different alkyl groups having from 1 to 6 carbon atoms and x is from 1 to 6.

In accordance with an even further embodiment of this invention there is provided a vitreous bonded abrasive article comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed and wherein at least one of said substances has the general formula

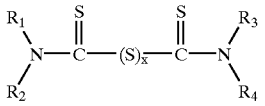

wherein $R_1$, $R_2$, $R_3$ and $R_4$ are the same or different aryl groups and x is from 1 to 6.

As a still further embodiment of this invention there is provided a vitreous bonded abrasive article comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed and wherein at least one of said substances has the general formula

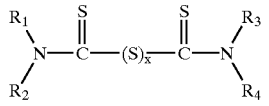

wherein $R_1$, $R_2$, $R_3$ and $R_4$ are the same or different arylalkyl groups and x is from 1 to 6.

There is provided in an even further practice of this invention a vitreous bonded abrasive article comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed and wherein at least one of said substances is tetraethyl thiuram disulfide.

The substances in accordance with the formula

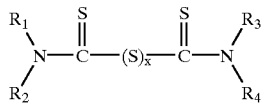

used herein are known by their general name as tetra organo thiuram sulfides and include mono sulfides where x is 1 and poly sulfides where is greater than 1 and where organo refers to the $R_1$, $R_2$, $R_3$ and $R_4$ groups. Thus for example where all the R groups would be methyl and x is 1, the substance would be known as tetramethyl thiuram monosulfide and where x is greater than 1, the substance would be known as tetramethyl thiuram polysulfide (e.g. disulfide, tetrasulfide, hexasulfide). It is intended that in the practice of this invention that the impregnant in accordance with this invention can be a mixture of the substances in accordance with invention. Thus, for example, the impregnant may comprise a mixture of tetraorgano thiuram monosulfides, a mixture of tetraorgano thiuram polysulfides as well as a mixture of tetraorgano thiuram monosulfides and tetraorgano thiuram polysulfides.

There has been found that the grinding performance of a vitreous bonded abrasive article (e.g. grinding wheel) having open porosity is improved by impregnating into that porosity as a grinding aid an impregnant that comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of such substances said impregnant being free of a medium, other than said substance, in which said substance or mixture of said substance is dissolved or dispersed. The sulfur bearing organic substance of the impregnant may contain several carbon to sulfur bonds and may contain both carbon to sulfur single bonds and carbon to sulfur double bonds. Further the sulfur bearing organic substance of the impregnant may also contain sulfur to sulfur bonds and/or sulfur to nitrogen bonds and/or sulfur to oxygen bonds in addition to the carbon to sulfur bond. While it is required that the sulfur bearing organic substance be water insoluble, absolute water insolubility is not required. Thus the term "water insoluble" is intended to include essentially water insoluble in accordance with the term "water insoluble" as previously defined herein.

The amount of water insoluble, sulfur bearing organic substance in accordance with this invention that is impregnated into the open pores of the vitreous bonded grinding wheel will depend upon such factors, as for example, the open porosity of the grinding wheel (i.e. the amount and size of the open pores), the viscosity of the water insoluble, sulfur bearing organic substance in the molten state as it is impregnated into the wheel, the pressure at which impregnation occurs, and the exposure time of the grinding wheel to the molten water insoluble, sulfur bearing organic substance. Complete impregnation of the open pores of the grinding wheel with the water insoluble, sulfur bearing organic substance in accordance with this invention is the preferred practice of the invention disclosed herein and claimed in the appended claims. In any case, it is intended that sufficient sulfur bearing organic substance be impregnated into the vitreous bonded article to be effective as a grinding aid in the machining conditions for which the wheel is intended to be used.

Advantageously improvements in grinding performance of vitreous bonded grinding wheels have been obtained in accordance with this invention when the open porosity of the grinding wheel solely (i.e. exclusively) contains the water insoluble, sulfur bearing organic substance in accordance with this invention. Thus advantageously a medium or carrier in which the water insoluble, sulfur bearing organic substance or mixture of such substances is dissolved or dispersed is not required nor used in accordance with this invention where such medium or carrier is a substance other than the water insoluble, sulfur bearing organic substance in accordance with this invention. It is contemplated and recognized that a mixture of two or more water insoluble, sulfur bearing organic substances each of which is in accordance with this invention may physically comprise one or more of such water insoluble, sulfur bearing organic substances dissolved or dispersed in another water insoluble, sulfur bearing organic substance which is in accordance with this invention.

The water insoluble, sulfur bearing organic substance in accordance with this invention in which one or more other water insoluble, sulfur bearing organic substances in accordance with this invention is dissolved or dispersed may be viewed as a medium or carrier for such dissolved or dispersed substances and is permissible in accordance with the invention disclosed herein and claimed in the appended claims. Thus for example in accordance with this invention a mixture of A and B, both of which are water insoluble, sulfur bearing organic substances in accordance with this invention that are chemically and/or physically distinguishable from each other can be used as the impregnant in the open pores of a vitreous bonded grinding wheel of the invention where B would be dissolved or dispersed in A and A may then be viewed as a medium or carrier for B. In such case this invention contemplates and would include a vitreous bonded abrasive article (e.g. grinding wheel) comprising a plurality of abrasive grains, a vitreous matrix binding together the abrasive grains and having distributed therein a plurality of open pores at least a portion of said pores containing a mixture of A and B both of which are water insoluble, sulfur bearing organic substances having at least one carbon to sulfur bond, at least 10% by weight sulfur and a melting point of at least about 30° C. which melting point is at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances and wherein B would be dissolved or dispersed in A and A would function as a medium or carrier for B. It is, however, not required that a mixture of two or more water insoluble, sulfur bearing organic substances in accordance with this invention comprise one or more of such water insoluble, sulfur bearing organic substances dissolved or dispersed in another water insoluble, sulfur bearing organic substance in accordance with this invention, rather, said mixture can comprise each of such substances as separate and physically distinct components of the mixture such as for example a mixture of sand and gravel.

Water insoluble, sulfur bearing organic substances contained in the open pores of the vitreous bonded abrasive article in accordance with the invention disclosed herein and claimed in the appended claims are solids at or about room temperature (e.g. 25° C.) as contemplated by the required melting point of at least about 30° C. Thus the vitreous bonded abrasive article (e.g. grinding wheel) in accordance with this invention at or about room temperature has a plurality of open pores containing an impregnant in accordance with this invention that is in a solid state. Preferably the water insoluble, sulfur bearing organic substance usable in accordance with this invention has a melting point high enough to maintain the impregnant in a solid state in the open pores of the vitreous bonded grinding wheel except only those pores present in the grinding zone. The water insoluble, sulfur bearing organic substance usable as an impregnant in the practice of this invention include but are not limited to, for example, sulfur bearing organic substances from such classes as organic sulfides, polysulfides, thiazoles, mercaptans, mercaptoacids and derivatives thereof, thio compounds, thiols, thio-esters, thioacids, substituted thioureas and sulfones. Examples of sulfur bearing organic substances in accordance with this invention usable in the practice of this invention include, but are not limited to, tetra isobutyl thiuram disulfide; tetraethyl thiuram disulfide (alternatively referred to as tetraethylthioperoxy dicarbonic diamide); diphenyl disulfide; tetraisobutyl thiuram monosulfide; dipentamethylene thiuram hexasulfide; tetramethyl thiuram disulfide; dipyridyl ethyl sulfide; tetrabenzyl thiuram disulfide; dicyclopentamethylene thiuram disulfide; bis(chlorobenzyl) disulfide; dibutyl tetrasulfide; isooctyl-3-mercaptopropionate; dioctyl mercaptosuccinate; p-chloro benzyl mercaptan; mercaptobenzo-thiazole; 2-mercaptobenzoic acid; thioacetalydehyde; thioacetamide; diphenylthiourea; 2-amino-5-sulfanilyl-thiozole; thiophenylamine; thiogylcollic-β-aminonaphtalide thiophene diiodide; 2-aminothiozole; N-oxydiethylene-2-benzothiazole sulfinamide; N,N-diethylthiourea; 1,3 dibutyl thiourea; diphenyl disulfide; dithiobisbenzothiazole; dibenzyl sulfide; thianaphthene; 2(morpholinothio) benzothiazole; dimercaptobenzothiazole; 4,4-dithiomorpholine; 4,4'-thiobis(6-tert-butyl-m-cresol); 4,4'thiobis (2-methyl-6-tert butyl phenol); 2,4-dimercapto-1,3,4-thiadiazole; dimethyl sulfone; dipentamethylene thiuram tetrasulfide; dichloro-diphenyl sulfone; dipentaerythritol hexa (3-mercaptopropionate); 4,4-diaminodiphenyl sulfone; butyl benzyl sulfonamide; dibenzyl sulfone, dibenzyl disulfide; thiosalicylic acid; thionalide (thioglycollic-β-aminophthalide). Other sulfur bearing organic substances usable in the practice of this invention include, but are not limited to, tetramethyl thiuram monosulfide; dithiodipropionic acid; bis(4-aminophenyl) sulfone and monochlorodiphenyl sulfone.

It is contemplated that in the practice of this invention, as described herein and claimed in the appended claims, there may be employed various abrasive grains including mixtures of abrasive grains of different composition and/or structure and/or size. Abrasive grains usable in the practice of this invention include, but are not limited to, fused alumina, sol-gel alumina, seeded sol-gel alumina, sintered sol-gel alumina, silicon carbide, cubic boron nitride, diamond, hexagonal boron nitride, titanium carbide, aluminum nitride and microcrystalline alumina. The sintered sol-gel alumina abrasive usable in this invention may be a sintered sol-gel, polycrystalline, high density (i.e. at least 95% of theoretical density) alpha alumina abrasive grit.

Abrasive grain or grit sizes of a wide range may be usable in the practice of this invention including, but not limited to, for example 24 to 220 mesh U.S. Standard Sieve Sizes.

The vitreous matrix in accordance with this invention is produced from a vitreous matrix precursor composition that is a mixture of materials which upon firing forms the vitreous matrix binding together the abrasive grain of the abrasive article. This vitreous matrix, also known in the art as a vitreous phase, vitreous bond, ceramic bond or glass bond, may be formed from a combination or mixture of oxides and silicates that upon being heated to a high temperature (e.g. firing temperature) react and/or fuse or may be formed from particles of frit that are fused together. Frit is a well known form of a vitreous, ceramic or glassy material produced from oxides and silicates, that upon being heated to a high temperature fuses to form a vitreous matrix. Primarily the oxides and silicates in the vitreous matrix precursor composition may be materials such as metal oxides, metal silicates and silica. The vitreous matrix may, for example, have an oxide based composition including any or all of silicon dioxide, titanium oxide, aluminum oxide, iron oxide, potassium oxide, sodium oxide, calcium oxide, barium oxide, boric oxide and magnesium oxide. Temperatures, for example, in the range of from 1000° F. to 2500° F. may be used to form the vitreous matrix binding together the abrasive grain in the practice of this invention. Such heating is commonly referred to as a firing step or firing and is usually carried out in a kiln or furnace where the temperatures and times that are employed in firing the abrasive article are controlled in accordance with such factors as the size and shape of the abrasive article, the composition and structure of the abrasive grain and the vitreous matrix precursor composition. Firing conditions of temperature, time and atmosphere well known in the art of making vitreous bonded abrasive articles (e.g. grinding wheels) may be used in the practice of this invention. In the practice of this invention it is desired that the vitreous matrix and the vitreous matrix precursor composition or mixture does not react with the abrasive grain in a manner that would have a detrimental effect upon the composition, structure and properties of the abrasive grain.

The vitreous bonded abrasive article in accordance with the invention disclosed herein and claimed in the appended claims has open pores. It is however recognized that said article may contain, to some degree, closed pores. A condition well recognized in the art. The porosity (i.e. the amount and type of pores) in the vitreous bonded abrasive article may be varied and controlled in the process of making the abrasive article in accordance with the intended use of the article. Thus in the art of vitreous bonded abrasive articles (e.g. grinding wheels) it is known to have varying amounts of open pores and closed pores ranging from few or no closed pores with the remaining porosity open pores to a high content of closed pores and few or no open pores. In the practice of this invention it is preferred to have high amounts of open pores (e.g. 65% open porosity, expressed as a percent by volume of the article) in the vitreous bonded abrasive article.

Size, amount and distribution of pores in bonded abrasive articles can be influenced by deliberate inclusion of materials that produce or contain voids, such materials referred to in the art as "pore inducers". Pore inducers may create open pores, that is voids in the finished bond; or closed pores, that is voids within the pore inducers themselves that are present in the vitrified bond. Generally closed cell porosity is produced by inorganic pore inducers such as performed hollow particles whose shape is retained upon firing the vitreous bonded abrasive article (e.g. grinding wheel) to form separated, non-interconnected closed cell pores or voids in the abrasive article.

Open cell porosity in vitreous bonded abrasive articles (e.g. grinding wheels) is generally produced by organic pore inducers which are volatized and or decomposed during firing to vitrify the bond. A number of materials, well known in the art, may be employed as the organic, open cell producing, pore inducers, in the practice of this invention to create the porosity in the vitreous bonded abrasive article in accordance with this invention. Such organic pore inducers can include, but are not limited to, for example such materials as crushed nut shells, synthetic polymers, resins, wood flour and high temperature (e.g. above 50° C.) melting and decomposing organic compounds and substances. Solid organic pore inducers are generally easier to work with in making vitreous bonded abrasive articles (e.g. grinding wheels) and are therefore preferred in the practice of this invention. The open pore structure of a vitreous bonded abrasive article, formed by organic pore inducers, generally has a wide range of pore sizes and shapes distributed within the vitreous matrix. In accordance with the vitreous bonded abrasive article of this invention it is the open pore structure of that article that contains the impregnant.

The open porosity of the vitreous bonded abrasive article (e.g. grinding wheel) in accordance with the invention described herein and claimed in the appended claims may vary over a wide range with respect to total and type (i.e. closed and open cell) porosity. The amount of pores or porosity of a vitreous bonded abrasive article is usually expressed as a percent by volume of the total volume of the article. Thus the vitreous bonded abrasive article in accordance with this invention may, for example, have an open cell porosity in the range of from about 20% by volume to about 65% by volume, preferably in the range of from about 25% by volume to about 58% by volume.

It is known in the art to use various additives in the making of vitreous bonded abrasive articles to improve the ease of making the article. Such additives can include, but are not limited to fillers, temporary binders and processing/aids. These additives, in amounts well known in the art, are optionally usable in the practice of this invention.

There may be used apparatus well known in the art for making the vitreous bonded abrasive article in accordance with this invention. Conventional blending and mixing techniques, conditions and equipment well known in the art may be used for producing the vitreous bonded abrasive article disclosed herein and claimed in the appended claims. Techniques, conditions and equipment for preparing the blend of abrasive grain, vitreous bond precursor and additives (e.g. temporary binder, pore inducers etc.) and pressing the blend to produce a cold molded abrasive article may be employed. Drying of the cold molded abrasive article prior to firing may be used to remove water or organic solvents usually introduced into the article with the temporary binder. After drying, the cold molded article, usually termed the green article or wheel, may be subjected to high temperatures, e.g. 1000° F. to 2500° F., to form the vitreous matrix binding together the abrasive grain and forming the pores of the article and thus the vitreous bonded abrasive article (e.g. grinding wheels). This firing step is usually carried out in a kiln or furnace in which the time, temperature, atmosphere and heating sequence (i.e. time temperature sequence) are controlled or variably controlled. Firing conditions well known in the art may be used in the practice of this invention.

In accordance with this invention at least a portion of the open pores of the vitreous bonded abrasive article (e.g. grinding wheels) contain an impregnant as disclosed herein and claimed in the appended claims. That impregnant can be introduced into open pores by a variety of methods. One such method generally involves contacting a heated vitreous bonded abrasive article with molten impregnant. Thus for example in one variation on such method a) the vitreous bonded abrasive article would be heated to a temperature equal to or preferably higher than, in some cases only slightly higher than, the melting point of any and all of the water insoluble, sulfur bearing organic substance components of the impregnant but below the decomposition temperature of said organic substance, b) the impregnant is heated to a temperature at or above the melting point of any and all of the water insoluble, sulfur bearing organic substance components of the impregnant but below the decomposition temperature of said components, preferably to a temperature which renders the impregnant quite fluid to produce an impregnant bath, c) the heated vitreous bonded abrasive article is at least partially immersed in the impregnant bath, d) the article is kept immersed long enough to maximize impregnation of open pores, and, advantageously, orientation of the article in the impregnant bath is intermittently or continuously altered during the period of immersion to facilitate impregnation of open pores throughout the article and e) the article then removed from the bath. It may, in some cases, be desirable that the temperature of the molten impregnant bath be higher than that of the heated article to prevent or reduce heat loss by the article during the impregnation process. Further, use of pressures above or below atmospheric pressure may be used in methods for impregnating vitreous bonded abrasive wheels with the impregnant of the invention. For example, the wheel and bath may be contained in an environment below atmospheric pressure to remove air from open pores of the bond lessening resistance to penetration of the pores by impregnant. Conversely, the wheel and bath may be contained in an environment above atmospheric pressure to force impregnant into the pores of the bond, driving out air. Upon removing the article from the molten impregnant bath the excess molten impregnant on the surface of the article is drained off and the article cooled to below the melting temperature of the impregnant. The specific temperature to which the vitreous bonded abrasive article and the impregnant are heated will depend upon the melting point and decomposition temperatures of the water insoluble, sulfur bearing organic substance component or components of the impregnant.

In another variation of a method for introducing impregnant to pores of the bond, heated impregnant, at a temperature at or above the melting point but below the decomposition temperature of any and all the water insoluble, sulfur bearing organic substance components of the impregnant, is flowed or poured onto the surface of the heated, slowly rotating vitreous bonded abrasive article, the temperature of the heated article being at or above the melting point of any and all of the water insoluble, sulfur bearing organic substance components of the impregnant, but below the decomposition temperature of such components, for a prescribed time, the rotation of the vitreous bonded abrasive article continued to drain excess impregnant from the surface of the wheel and the vitreous bonded abrasive article and impregnant therein cooled, with or without rotation of the article to a temperature below the melting point of all water insoluble, sulfur bearing organic substance components of the impregnant.

Other methods may be employed in producing the vitreous bonded abrasive article in accordance with the invention disclosed herein and claimed in the appended claims including contacting a vitreous bonded abrasive article (e.g. grinding wheel) with a solvent solution of the impregnant that is in accordance with this disclosed and claimed invention and thereafter removing the solvent from the vitreous bonded abrasive article. As employed in accordance with the vitreous bonded abrasive article disclosed herein and claimed in the appended claims it is intended that the disclosed and claimed impregnant shall be as it exists in the open pores of said abrasive article at the time said abrasive article shall be available for its intended use and shall not refer or pertain to the means by which said impregnant is incorporated into the open pores of said abrasive article.

It is required that the vitreous bonded abrasive article in accordance with this invention have a plurality of open pores and that at least a portion of said pores contain an impregnant as described herein and claimed in the appended claims. The phrase "at least a portion of said pores containing an impregnant" refers to and pertains to the amount of open pores containing an impregnant in accordance with this invention as well as to the amount of impregnant in accordance with this invention in each open pore. Thus in accordance with this invention a) the amount of open pores containing an impregnant, and b) the amount of impregnant in each open pore may vary over a wide range. The amount of said impregnant contained in each open pore may vary in a continuous or discontinuous manner throughout the volume of the vitreous bonded abrasive article disclosed herein and claimed in the appended claims. It is contemplated, but not preferred, that at least some open pores will not contain an impregnant.

The vitreous bonded abrasive article invention as disclosed herein and claimed in the appended claims can take various forms, shapes and structures in accordance with the intended use of the abrasive article. Examples of such forms, shapes and structures include, but are not limited to, grinding wheels, abrasive grinding segments which can be used to construct a grinding or abrasive tool, segmented abrasive article, cup shaped grinding article, rimmed grinding wheels, cone shaped grinding wheels, abrasive bars and specific shaped vitreous bonded abrasive tools (i.e. vitreous bonded abrasive tools shaped to be used in specific grinding operations).

This invention will now be further described in the following non-limiting examples wherein, unless otherwise specified, the amounts and percentages are by weight, the temperature in degree Fahrenheit, time in minutes, linear measurements in inches, mesh or grit size in U.S. Standard Sieve Sizes and wherein:

1) CUBITRON 321 is a sol-gel alumina abrasive grain obtained from the Minnesota Mining and Manufacturing Company. CUBITRON is a registered trademark of the Minnesota Mining and Manufacturing Company;
2) 3029 UF Resin is a 65% by weight urea formaldehyde resin 35% by weight water composition;
3) CHRUNCHLETS CR 20 are particles containing sugar and starch, the particles having a weight ratio of sugar to starch of 78.5 to 21.5 and a particle size in the range of 16 to 45 mesh, obtained from Custom Industries Inc. CHRUNCHLETS is a registered trademark of Custom Industries Inc.;
4) NORLIG is a 50% aqueous solution of calcium lignosulfonate obtained from LignoTech USA. NORLIG is a registered trademark of LignoTech USA.
5) Dual Screen Aggregate AD 6 is a ground vegetable shell material having a particle size in the range of from 20 to 40 mesh obtained from Agrashell Inc. and
6) Bond (vitreous matrix precursor) has a mole % oxide based composition of

| Oxide | Bond A | Bond B | Bond C | Bond D | Bond E |
|---|---|---|---|---|---|
| $SiO_2$ | 63.32 | 61.75 | 67.39 | 53.56 | 79.52 |
| $Al_2O_3$ | 10.96 | 10.68 | 13.56 | 13.46 | 8.94 |
| $TiO_2$ | 0.33 | 2.80 | 0.70 | 0.21 | 0.13 |
| $Fe_2O_3$ | 0.13 | 0.07 | 0.14 | 0.14 | 0.26 |
| $B_2O_3$ | 5.12 | 5.01 | 4.08 | 19.44 | 0 |
| $K_2O$ | 3.79 | 3.74 | 3.65 | 2.21 | 2.74 |
| $Na_2O$ | 4.25 | 4.14 | 3.37 | 10.68 | 1.50 |
| $Li_2O$ | 4.98 | 4.81 | 0 | 0 | 0 |
| CaO | 3.85 | 3.81 | 3.79 | 0.14 | 1.57 |
| MgO | 3.06 | 3.00 | 3.30 | 0.14 | 5.35 |
| BaO | 0.20 | 0.20 | 0 | 0 | 0 |

Methods for Producing Vitreous Bonded Grinding Wheels of the Examples

Method No. 1: The components of the formulation were combined together in the following manner in accordance with the percentages given in the formulation. Where two or more abrasive grains of different chemical composition, physical structure and properties and size were used they were blended together prior to the following steps. The abrasive grain, 3029 UF resin and ethylene glycol were blended together until uniform coating of the abrasive grain was achieved. To the resulting mixture was added a combination of the bond blend and Dextrin powder with mixing and mixing continued until a uniform mixture was obtained. This was followed by the addition of CHRUNCHLETS CR 20 particles with agitation until a uniform blend was achieved. The resulting mixture was screened to remove undesirable lumps and a predetermined amount of the mix was placed in the cavity of a steel mold of the shape and approximate size of the wheel to be produced. After uniformly distributing the blend in the mold cavity, it was cold pressed to compact the blend to the mold cavity dimensions. The compacted blend (i.e. green wheel) was then removed from the mold and subjected to a drying cycle by heating the green wheel from room temperature to 275° F. for 13 hours and ambient air cooling it to room temperature. The dried green wheel was then given a firing cycle in air of from room temperature to 1650° F. over eleven hours, held at 1650° F. for 12 hours, heated from 1650° F. to 2100° F. over 6.5 hours and held at 2100° F. for 3 hours. The wheel was then cooled in ambient air to room temperature over 27.5 hours. The wheel was then adjusted to the desired size.

Method No. 2: Same as Method No. 1 except starch was substituted for the CHRUNCHLETS CR 20 of Method No. 1 and the green wheel was given a firing cycle in air of from room temperature to 1650° F. over 11 hours, held at 1650° F. for 12 hours, heated from 1650° F. to 2300° F. over 9.5 hours and held at 2300° F. for 3 hours. The wheel was then cooled in ambient air to room temperature over 27.5 hours and the cooled wheel adjusted to the desired size.

Method No. 3: The components of the formulation were combined together in the following manner in accordance with the percentages given in the formulation. The different size abrasive grains were blended together to form a uniform mixture of the abrasive grains. Dual Screen Aggregate AD 6 was then blended with the abrasive grain mixture to form a uniform blend. NORLIG and water were then added to the resulting blend with mixing and mixing continued until the surfaces of the abrasive grains were substantially uniformly coated. Dextrin and the Bond were thoroughly mixed together, the resulting mixture then added with blending to the coated abrasive grain until a uniform blend was obtained and a predetermined amount of the resulting mix was placed in a steel mold cavity having the shape and approximate size of the grinding wheel to be produced. After uniformly distributing the mix in the cavity the mix was cold pressed to compact the blend to the mold cavity dimensions. The compacted blend (i.e. green wheel) was then removed from the mold and subjected to a drying cycle by heating the green wheel from room temperature to 275° F. for 13 hours and then ambient air cooling it to room temperature. The green wheel was then given a firing cycle in air by heating it from room temperature to 1650° F. over 11 hours, holding it at 1650° F. for 12 hours, heating it from 1650° F. to 2000° F. over 5 hours and holding it at 2000° F. for 3 hours. The wheel was then cooled in ambient air to room temperature over 27.5 hours and then adjusted to the desired size.

In the following examples, wheel size is stated as diameter× width×bore. Grinding Wheel Example No. 1

Formulation

| | |
|---|---|
| CUBITRON 321 abrasive 60 grit | 30.0 |
| Fused Alumina 9A 60 grit | 70.0 |
| 3029 UF Resin | 2.8 |
| Bond A | 12.0 |
| Dextrin | 3.0 |
| Ethylene glycol | 0.4 |
| CHRUNCHLETS CR20 | 2.5 |

Method of producing wheel: Method No. 1 Wheel size 14×0.5×5.0 inches

Grinding Wheel Example No. 2

Formulation

| | |
|---|---|
| Fused Alumina 2A 60 grit | 40.0 |
| Fused Alumina 9A 60 grit | 60.0 |
| Bond B | 12.0 |
| 3029 UF Resin | 2.4 |
| Dextrin | 2.0 |
| Ethylene glycol | 0.2 |
| Starch | 0.3 |

Method of producing wheel: Method No. 2 Wheel size 14×0.5×5.0 inches

Grinding Wheel Example No. 3

Formulation

| | |
|---|---|
| Fused Alumina 12A 80 grit | 100.0 |
| Bond C | 12.3 |
| 3029 UF Resin | 2.4 |
| Dextrin | 2.0 |
| Ethylene glycol | 0.2 |
| Starch | 0.4 |

Method of producing wheel: Method No. 2 Wheel size 12×1.0×3.0 inches

Grinding Wheel Example No. 4

Formulation

| | |
|---|---|
| Fused Alumina 12A 36 grit | 34.0 |
| Fused Alumina 12A 46 grit | 33.0 |
| Fused Alumina 12A 54 grit | 33.0 |
| Bond D | 14.58 |
| Water | 0.98 |
| NORLIG | 2.39 |
| Dextrin | 2.00 |
| Dual Screen Aggregate AD 6 | 3.01 |

Method of producing wheel: Method No. 3 Wheel size 12×1.0×5.0 inches

Grinding Wheel Example No. 5

Formulation

| | |
|---|---|
| Fused Alumina 9A 36 grit | 34.0 |
| Fused Alumina 9A 46 grit | 33.0 |
| Fused Alumina 9A 54 grit | 33.0 |
| Bond D | 14.58 |
| Water | 0.98 |
| NORLIG | 2.39 |
| Dextrin | 2.00 |
| Dual Screen Aggregate AD 6 | 3.01 |

Method of producing wheel: Method No. 3 Wheel size 12×1.0×5.0 inches

Grinding Wheel Example No. 6

Formulation

| | |
|---|---|
| Silicon carbide 90 grit | 100.00 |
| Bond E | 19.58 |
| 3029 UF Resin | 5.30 |
| Ethylene glycol | 0.70 |
| Dextrin | 2.39 |
| Dual Screen Aggregate AD 6 | 4.19 |

Method of producing: Method No. 2 Wheel size: 12×1.0×5.0 inches

The impregnated grinding wheel examples below were prepared in the following manner. The grinding wheel to be impregnated, having a ring like configuration, was thoroughly and evenly heated to a temperature at least about 10° C. higher than the melting point of the impregnant and them immediately placed in a heated pan with a flat side resting on the inside bottom of the pan. Melted impregnant was then carefully poured into the center opening of the wheel but not onto the top surface of the wheel. Upon absorption of the impregnant into the wheel, the exposed surface of the wheel exhibits a wet appearance. When the surface of the wheel showed an even wet appearance the wheel was removed from the pan, flipped over and suspended above a catch basin until impregnant began to drain from the then lower surface of the wheel. The wheel was then flipped over so that the originally exposed surface was again the top surface and the wheel was placed on an absorbent material, such as cotton cloth. Thereafter, the wheel was flipped at intervals approximating the time elapsed from removal of the wheel from the pan until impregnant began draining from the wheel. Flipping of the wheel was continued until the impregnant solidified, where upon the flipping was ceased and the impregnated wheel set aside.

Impregnated Grinding Wheel Example No. A.
Grinding Wheel Example No. 1
Impregnant—tetraethyl thiuram disulfide Impregnated Grinding Wheel Example No. B
Grinding Wheel Example No. 2
Impregnant—tetraethyl thiuram disulfide Impregnated Grinding Wheel Example No. C
Grinding Wheel Example No. 3
Impregnant—tetraethyl thiuram disulfide Impregnated Grinding Wheel Example No. D
Grinding Wheel Example No. 4
Impregnant—tetraethyl thiuram disulfide Impregnated Grinding Wheel Example No. E
Grinding Wheel Example No. 5
Impregnant—tetraethyl thiuram disulfide Impregnated Grinding Wheel Example No. F
Grinding Wheel Example No. 5
Impregnant—1,3 dibutyl thiourea Impregnated Grinding Wheel Example No. G
Grinding Wheel Example No. 5
Impregnant—N-oxydiethylene-2-benzothiazole sulfenamide Impregnated Grinding Wheel Example No. H
Grinding Wheel Example No. 5
Impregnant—N,N diethyl thiourea Impregnated Grinding Wheel Example No. I
Grinding Wheel Example No. 5

Impregnant—tetraisobutyl thiuram disulfide

Impregnated Grinding Wheel Example No. J
Grinding Wheel Example No. 5
Impregnant—dibenzyl sulfide Impregnated Grinding Wheel Example No. K
Grinding Wheel Example No. 6
Impregnant—tetraethyl thiuram disulfide Impregnated Grinding Wheel Example No. L
Grinding Wheel Example No. 5
Impregnant—monochlorodiphenyl sulfone Impregnated Grinding Wheel Example No. M
Grinding Wheel Example No. 5
Impregnant—50% tetraethyl thiuram disulfide and 50% tetraisobutyl thiuram disulfide by weight Impregnated Grinding Wheel Example No. N
Grinding Wheel Example No. 5
Impregnant—distearyl dithiodipropionate The following test procedures were followed in performing the grinding tests reported in the table below.

Test Procedure No. 1: The grinding wheel was mounted on a Universal Center type grinder and plunge grinding performed at the indicated specific metal removal rate (Q') on a 10×0.51×3.18 cm. (4×0.20×1.25 inch) 4145 tubular steel workpiece having a Rockwell C hardness of 52–54 rotating at 60.96 surface meters (200 surface feet) per minute, using a wheel speed of 1718 RPM. CIMSTAR® 40 metalworking fluid diluted with water to a use concentration of about 2.5% was used at the grinding interface during the test. CIMSTAR is a registered trademark of Milacron Inc. Each test was conducted to remove 1.270 cm. (0.500 inch) from the diameter of the workpiece and measurements made of the metal removed and wheel wear for computing G ratio values.

Test Procedure No. 2: The grinding wheel was mounted on a surface grinder and surface grinding performed wherein the grinding wheel rotating at 6000 surface feet per minute was forced against and passed over a 100 square inch flat surface of a block of SAE 8617 steel at the indicated specific metal removal rate (Q'). Advance of the grinding wheel toward the block was by a constant incremental distance and the wheel was traversed at constant depth over the area of the block. The interface between the wheel and the steel block was flooded with CIMTECH® 95 grinding fluid diluted with water to a use concentration of about 2.5%. CIMTECH is a registered trademark of Milacron Inc. The diluted fluid was re-circulated from a reservoir through the grinding wheel/steel block interface and back to the reservoir. Repeated grinding passes were made over the steel block to achieve the stated specific metal removal rate using different infeed rates (incremental advance of wheel toward block), the last five traverses of the wheel over the block was made without further advance of the wheel to relieve forces and eliminate deflections from elastic yielding of supports for the wheel and/or the block. The volumes of grinding wheel and steel block were measured before and after the test for determining the volume of grinding wheel reduction and volume of material removed from the steel block. The measurements were made in the same units for the grinding wheel and steel block. G-ratio was then calculated by dividing the volume of grinding wheel lost into the volume of steel removed from the block.

Test Procedure No. 3: Same as Test Procedure No. 2 except a grinding wheel speed of 4000 surface feet per minute was used.

TABLE 1

Grinding Test Results

| Test No. | Wheel No. | Test Method No. | Q' | G-Ratio |
|---|---|---|---|---|
| 1 | 1 | 1 | 0.4 | 31.88 |
| 2 | 1 | 1 | 0.6 | 25.22 |
| 3 | 1 | 1 | 0.8 | 19.32 |
| 4 | A | 1 | 0.4 | 43.98 |
| 5 | A | 1 | 0.6 | 33.05 |
| 6 | A | 1 | 0.8 | 50.17 |
| 7 | 2 | 1 | 0.4 | 20.08 |
| 8 | 2 | 1 | 0.6 | 12.07 |
| 9 | 2 | 1 | 0.8 | 6.05 |
| 10 | B | 1 | 0.4 | 28.07 |
| 11 | B | 1 | 0.6 | 19.46 |
| 12 | B | 1 | 0.8 | 8.59 |
| 13 | 3 | 2 | 0.36 | 4.2 |
| 14 | 3 | 2 | 0.72 | 2.13 |
| 15 | 3 | 2 | 1.08 | 1.35 |
| 16 | C | 2 | 0.36 | 8.19 |
| 17 | C | 2 | 0.72 | 3.35 |
| 18 | C | 2 | 1.08 | 2.45 |
| 19 | 4 | 2 | 0.36 | 14.71 |
| 20 | 4 | 2 | 0.72 | 6.97 |
| 21 | 4 | 2 | 1.08 | 4.1 |
| 22 | D | 2 | 0.36 | 30.69 |
| 23 | D | 2 | 0.72 | 9.95 |
| 24 | D | 2 | 1.08 | 6.44 |
| 25 | 5 | 2 | 1.08 | 4.09 |
| 26 | E | 2 | 1.08 | 8.13 |
| 27 | 5 | 2 | 1.08 | 4.09 |
| 28 | F | 2 | 1.08 | 6.33 |
| 29 | 5 | 2 | 1.08 | 4.09 |
| 30 | G | 2 | 1.08 | 5.76 |
| 31 | 5 | 2 | 1.08 | 4.09 |
| 32 | H | 2 | 1.08 | 4.86 |
| 33 | 5 | 2 | 1.08 | 4.09 |
| 34 | I | 2 | 1.08 | 5.77 |
| 35 | 5 | 2 | 0.72 | 11.07 |
| 36 | J | 2 | 0.72 | 14.26 |
| 37 | 5 | 2 | 1.08 | 5.37 |
| 38 | J | 2 | 1.08 | 7.85 |
| 39 | 6 | 3 | 1.08 | 1.59 |
| 40 | K | 3 | 1.08 | 2.61 |
| 41 | 5 | 2 | 1.08 | 4.09 |
| 42 | L | 2 | 1.08 | 6.02 |
| 43 | 5 | 2 | 1.08 | 4.09 |
| 44 | M | 2 | 1.08 | 7.51 |
| 45 | 5 | 2 | 1.08 | 4.09 |
| 46 | N | 2 | 1.08 | 4.54 |

In Table 1 the Wheel No. given a numeric value refers to the unimpregnated vitreous bonded grinding wheel of the corresponding example number whereas the Wheel No. given an alphabetic character refers to the impregnated vitreous bonded grinding wheel of the corresponding example having the alphabetic character.

Improvement in grinding performance may be determined by comparing the G-ratio values, obtained under the same grinding test conditions, for the unimpregnated grinding wheel and the impregnated grinding wheel and may be expressed as a percent change in G-ratio. A positive percent change in G-ratio would indicate improvement in grinding performance whereas a negative percent change in G-ratio would point to a decrease in grinding performance. The larger the positive percent change in G-ratio the greater the improvement in grinding performance. Percent change in G-ratio is determined by the following formula:

$$(G_2-G_1)/G_1*100=\%\text{change in G-ratio}$$

where: $G_1$=G-ratio for the unimpregnated grinding wheel
$G_2$=G-ratio for the impregnated grinding wheel

TABLE 2

Improvement in Grinding Performance

| Example No. for G2 | Example No. for G1 | Q' | G-ratio % Change |
|---|---|---|---|
| A | 1 | 0.4 | 37.95 |
| A | 1 | 0.6 | 31.05 |
| A | 1 | 0.8 | 159.68 |
| B | 2 | 0.4 | 39.79 |
| B | 2 | 0.6 | 61.23 |
| B | 2 | 0.8 | 41.98 |
| C | 3 | 0.36 | 95.00 |
| C | 3 | 0.72 | 57.23 |
| C | 3 | 1.08 | 81.48 |
| D | 4 | 0.36 | 108.63 |
| D | 4 | 0.72 | 42.75 |
| D | 4 | 1.08 | 57.07 |
| E | 5 | 1.08 | 98.78 |
| F | 5 | 1.08 | 54.77 |
| G | 5 | 1.08 | 40.83 |
| H | 5 | 1.08 | 18.83 |
| I | 5 | 1.08 | 41.08 |
| J | 5 | 0.72 | 29.82 |
| J | 5 | 1.08 | 46.18 |
| K | 6 | 1.08 | 64.15 |
| L | 5 | 1.08 | 47.19 |
| M | 5 | 1.08 | 83.62 |
| N | 5 | 1.08 | 11.00 |

What is claimed is:

1. A vitreous bonded abrasive article comprising a plurality of abrasive grains, a vitreous matrix binding together the abrasive grains and having distributed therein a plurality of open pores, at least a portion of said pores containing as an impregnant therein a grinding aid wherein said impregnant comprises at least one water insoluble, sulfur bearing organic substance said substance having at least one carbon to sulfur bond, at least about 5% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or mixture of said substances is dissolved or dispersed.

2. A vitreous bonded abrasive article according to claim 1 wherein the melting point of the substance is at least 20° C. below the decomposition temperature of the substance.

3. A vitreous bonded abrasive article according to claim 1 wherein the substance has a sulfur content in the range of from about 15% to about 60% by weight and the melting point is at least 20° C. below the decomposition temperature of the substance.

4. The vitreous bonded abrasive article according to claim 1 wherein the melting point is in the range of from about 30° C. to about 500° C.

5. The vitreous bonded abrasive article according to claim 1 wherein the substance has a sulfur content in the range of from about 15% to about 60% by weight, a melting point in the range of from about 40° C. to about 250° C. and the melting point is at least 20° C. below the decomposition temperature of the substance.

6. The vitreous bonded abrasive article according to claim 1 wherein said substance has a sulfur content in the range of from about 15% to about 60% by weight, a melting point in the range of from about 40° C. to about 250° C., the melting point being at least 20° C. below the decomposition temperature of the substance and additionally contains at least one carbon to halogen bond.

7. The vitreous bonded abrasive article according to claim 1 wherein the abrasive grains are selected from the group consisting of abrasive grains of any of fused alumina, sol-gel alumina and silicon carbide and mixtures of such abrasive grains.

8. A vitreous bonded abrasive article in accordance with claim 1 wherein the open porosity is in the range of from about 20% to about 65% by volume.

9. A vitreous bonded abrasive article comprising a plurality of abrasive grains, a vitreous matrix binding together the abrasive grains and having distributed therein a plurality of open pores, at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or a mixture of said substances is dissolved or dispersed and wherein at least one of said substances has the general formula

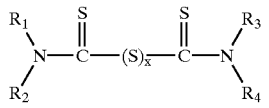

wherein $R_1$, $R_2$, $R_3$ and $R_4$ are the same or different and are selected from the group consisting of alkyl, cycloalkyl, aryl, alkylaryl and arylalkyl groups and x is from 1 to 6.

10. A vitreous bonded abrasive article according to claim 9 wherein $R_1$, $R_2$, $R_3$ and $R_4$ are alkyl having from 1 to 4 carbon atoms.

11. A vitreous bonded abrasive article according to claim 9 wherein at least one of said substances is tetraethyl thiuram disulfide.

12. A vitreous bonded abrasive article according to claim 9 wherein $R_1$, $R_2$, $R_3$ and $R_4$ are cycloalkyl groups.

13. A vitreous bonded abrasive article according to claim 9 wherein $R_1$, $R_2$, $R_3$ and $R_4$ are aryl groups.

14. A vitreous bonded abrasive article according to claim 9 wherein $R_1$, $R_2$, $R_3$ and $R_4$ are arylalkyl groups.

15. A vitreous bonded abrasive article according to claim 9 wherein $R_1$, $R_2$, $R_3$ and $R_4$ are benzyl.

16. The vitreous bonded abrasive article in accordance with claim 9 wherein x is 1 to 4.

17. The vitreous bonded abrasive article according to claim 9 wherein the abrasive grains are selected from the group consisting of abrasive grains of any of fused alumina, sol-gel alumina and silicon carbide and mixtures of such abrasive grains.

18. A vitreous bonded abrasive article according to claim 9 wherein the open porosity is in the range of from about 20% to about 65% by volume.

19. A vitreous bonded abrasive article comprising a plurality of abrasive grains, a vitreous matrix binding together the abrasive grains and having distributed therein a plurality of open pores at least a portion of said pores containing as an impregnant therein a grinding aid wherein said impregnant comprises at least one water insoluble, sulfur bearing organic substance said substance having at least one carbon to sulfur bond, at least about 10% by weight sulfur and a melting point of at least about 30° C. said melting point being at least 10° C. below the decomposition temperature of the substance and selected from the group the consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance is dissolved or dispersed and wherein at least one of said substances is a sulfide selected from the group consisting of aliphatic, aromatic, cycloaliphatic, aryl substituted aliphatic and alkyl substituted aromatic monosulfide and polysulfide.

20. The vitreous bonded abrasive article in accordance with claim 19 wherein at least one of said substances is an aliphatic monosulfide.

21. A vitreous bonded abrasive article in accordance with claim 19 wherein at least one of said substances is an aliphatic polysulfide.

22. A vitreous bonded abrasive article in accordance with claim 19 wherein at least one of said substances is an aromatic monosulfide.

23. The vitreous bonded abrasive article according to claim 19 wherein at least one of said substances is an aromatic polysulfide.

24. The vitreous bonded abrasive article according to claim 19 wherein at least one of said substances is arylalkyl polysulfide.

25. A vitreous bonded abrasive article in accordance with claim 19 wherein at least one of said substances is an arylalkyl monosulfide.

26. A vitreous bonded abrasive article according to claim 19 wherein at least one of said substances is selected from the group consisting of halogen substituted alkyl, aryl, arylalkyl and alkylaryl monosulfides and polysulfides.

27. The vitreous bonded abrasive article according to claim 19 wherein the abrasive grains are selected from the group consisting of abrasive grains of any of fused alumina, sol-gel alumina and silicon carbide and mixtures of such abrasive grains.

28. A vitreous bonded abrasive article in accordance with claim 19 wherein the open porosity is in the range of from about 20% to about 65% by volume.

29. A vitreous bonded abrasive article comprising a plurality of abrasive grains, a vitreous matrix binding together the abrasive grains and having distributed therein a plurality of open pores, at least a portion of said pores containing as an impregnant therein a grinding aid wherein said impregnant comprises at least one water insoluble, sulfur bearing organic substance said substance having at least one carbon to sulfur bond, at least about 5% by weight sulfur and a melting point of at least about 30° C. said melting point being at least 10° C. below the decomposition temperature of said substance and selected from the group consisting of substituted and unsubstituted aliphatic, aromatic, cycloaliphatic, alkenyl, alkynyl, alkylaryl, arylalkyl and substituted heterocyclic sulfur bearing organic substances or a mixture of said substances, said impregnant being free of a medium, other than said substance, in which said substance or a mixture of said substances is dissolved or dispersed and wherein at least one of said substances is selected from the group consisting of mercaptoacids, derivatives of mercaptoacids, thioacids, derivatives of thioacids, substituted thiorea, sulfones, and thiazoles.

30. A vitreous bonded abrasive article according to claim 29 wherein at least one of said substances is selected from the group consisting of aliphatic mercaptoacids and sulfur bearing derivatives thereof.

31. The vitreous bonded abrasive article in accordance with claim 29 wherein at least one of said substances is selected from the group consisting of aromatic mercaptoacids and sulfur bearing derivatives thereof.

32. The vitreous bonded abrasive article according to claim 29 wherein at least one of said substances is selected from the group consisting of aliphatic thioacids and sulfur bearing derivatives thereof.

33. The vitreous bonded abrasive article in accordance with claim 29 wherein at least one of said substances is selected from the group consisting of aromatic thioacids and sulfur bearing derivatives thereof.

34. The vitreous bonded abrasive article in accordance with claim 29 wherein at least one of said substances is an aliphatic thiourea.

35. A vitreous bonded abrasive article according to claim 29 wherein at least one of said substances is an aromatic thiourea.

36. A vitreous bonded abrasive article according to claim 29 wherein at least one of said substances is an arylalkyl thiourea.

37. A vitreous bonded abrasive article according to claim 29 wherein at least one of said substances is a cycloalkyl thiourea.

38. The vitreous bonded abrasive article according to claim 29 wherein at least one of said substances is an aliphatic sulfone.

39. The vitreous bonded abrasive article according to claim 29 wherein at least one of said substances is an aromatic sulfone.

40. The vitreous bonded abrasive article in accordance with claim 29 wherein the abrasive grains are selected from the group consisting of abrasive grains of any of fused alumina, sol-gel alumina and silicon carbide and mixtures of such abrasive grains.

41. The vitreous bonded abrasive article according to claim 29 wherein the open porosity is in the range of from about 20% to about 65% by volume.

* * * * *